United States Patent [19]

Allen et al.

[11] 4,287,680

[45] Sep. 8, 1981

[54] MECHANICAL ACTION TOY

[75] Inventors: Robert K. Allen, Cincinnati, Ohio; Alan A. Hicks, Chicago, Ill.; Harry Disko, S. Barrington, Ill.

[73] Assignee: Marvin Glass & Associates, Chicago, Ill.

[21] Appl. No.: 119,885

[22] Filed: Feb. 8, 1980

[51] Int. Cl.[3] ..... A63H 33/00

[52] U.S. Cl. ..... 46/1 R; 46/43; 46/47

[58] Field of Search ..... 46/1 R, 47, 43, 39, 46/32, 38, 42, 175 R, 40

[56] References Cited

U.S. PATENT DOCUMENTS

| | | | |
|---|---|---|---|
| 1,274,979 | 8/1918 | Bliley | 46/43 |
| 2,400,013 | 5/1946 | Lowell et al. | 46/43 |
| 2,998,673 | 9/1961 | Rhodes | 46/43 |
| 3,437,338 | 4/1969 | Glass et al. | 46/40 X |
| 4,159,593 | 7/1979 | Miller | 46/42 |

OTHER PUBLICATIONS

"Marble Pump", Marlin Toy Products Inc. Horicon, Wis., Mar. 1966.

*Primary Examiner*—Gene Mancene
*Assistant Examiner*—Mickey Yu
*Attorney, Agent, or Firm*—Mason, Kolehmainen, Rathburn & Wyss

[57] ABSTRACT

A mechanical action toy for young children and the like includes a housing or enclosure having a plurality of separate compartments in communication with each other and one of the compartments is provided with an exterior wall of light transmitting material comprising a window to permit viewing of the interior. A dump truck having a movable hopper is mounted in the window compartment and is adapted to contain a plurality of playing pieces such as marbles or the like which are collected in the hopper and subsequently may be dumped therefrom. A manually activated elevator system is provided in the other compartment for collecting dumped out marbles and elevating the same for discharge back into the hopper of the dump truck after the hopper is returned to a collecting or marble holding position.

In addition, the toy apparatus includes a pair of wheels which are driven to rotate and to move up and down to resemble traveling over a rough and bumpy road. An animated figure in the form of a truck driver is mounted in the cab of the dump truck and is selectively movable. A push button whistle is provided to make a sound that resembles the toot of a horn and another sound generator is incorporated with the system for drivingly rotating and moving the truck wheels up and down.

22 Claims, 7 Drawing Figures

MECHANICAL ACTION TOY

BACKGROUND OF THE INVENTION

1. Field of the Invention

The present invention relates to mechanical action toys and more particularly to mechanical action toys which are designed for young children and the like to simulate real-life activities during play.

2. Description of the Prior Art

A wide variety of toy vehicles such as dump trucks and the like have been provided as toys for young children and a large selection of pinball type games are common wherein a player may control the movement of a plurality of balls in a containing enclosure.

As far as is known, however, no mechanical action toys have been developed wherein a toy dump truck is mounted within a pinball type enclosure and includes various mechanical systems therein adapted to simulate the real-life action of loading and dumping materials from the hopper of the truck while additionally providing for upward and downward movement of the truck wheels as they rotate simulating the movement of a truck over a bumpy road.

OBJECTS OF THE PRESENT INVENTION

It is an object of the present invention to provide a new and improved mechanical action toy of the character described and more particularly, to provide a new and improved toy apparatus which provides a close simulation of the actions of a dump truck type vehicle at work.

More particularly, it is an object of the present invention to provide a new and improved toy apparatus of the character described wherein a toy dump truck is mounted within an enclosure which also contains a plurality of playing elements such as balls or marbles which are movable into and out of the dump truck hopper under the manual control of the child or person playing with the apparatus.

Another object of the present invention is to provide a new and improved toy apparatus of the character described which closely appears to simulate the actions of a truck or other vehicle moving down a bumpy road.

Still another object of the present invention is to provide a new and improved toy apparatus of the character described wherein an animated figure such as a truck driver is movably disposed within a cab of the vehicle.

Still another object of the present invention is to provide a new and improved toy apparatus of the character described wherein a sound generator is provided to develop the sound of a tooting horn of a truck type vehicle.

Still another object of the present invention is to provide a new and improved animated action toy of the character described wherein a plurality of movable elements such as balls or marbles are manually controlled for movement within an enclosure between a compartment that is substantially hidden from external view and an exposed compartment having a window wherein the balls may be seen as they are moved during play.

Still another object of the present invention is to provide a new and improved toy apparatus of the character described which is pleasing and neat in appearance and which is capable of attracting the attention and maintaining the interest of a young child for long periods of play.

Still another object of the present invention is to provide a new and improved dump truck toy apparatus of the character described which is economical to manufacture and which is particularly designed to retain movable playing pieces such as balls or marbles and the like within an enclosure to prevent the loss of the playing pieces.

SUMMARY OF THE INVENTION

The foregoing and other objects and advantages of the present invention are accomplished in a new and improved mechanical action toy apparatus comprising an enclosure or housing having a plurality of separate compartments in communication with each other. One of the compartments has an exterior wall of light transmitting material forming a window to permit the interior thereof to be viewed and the other compartment is substantially hidden from view. A toy dump truck is mounted in the window compartment and is provided with a hopper that is movable between a first position for receiving and holding a plurality of playing pieces such as balls or marbles that are discharged into the hopper from the hidden compartment. The hopper is manually controlled for dumping collected marbles out for collection at a lower level in the hidden compartment and a manually controlled elevator system is provided for moving the balls collected at a lower level in the hidden compartment back upwardly to a higher level for discharge into the hopper of the dump truck.

The dump truck includes a pair of wheels which are mounted for rotation as well as linear motion up and down in response to the operation of an endless belt which resembles a bumpy roadway and which is driven to move beneath the wheels by a manual crank. The toy apparatus further includes a sound generator driven by the crank as well as an independently activated whistle which may be operated at random to produce the toot of a horn. An animated figure in the form of a truck driver sitting in the cab of the dump truck is manually controllable for rocking movement to provide additional realism for a young child.

The toy apparatus is operable so that the hopper of the dump truck may be filled with marbles or balls and then the balls may be dumped out of the hopper by manually controlled movement from a receiving to a dumping position. The apparatus is pleasing in appearance and is self-contained so that the balls are contained against loss during play or storage periods.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
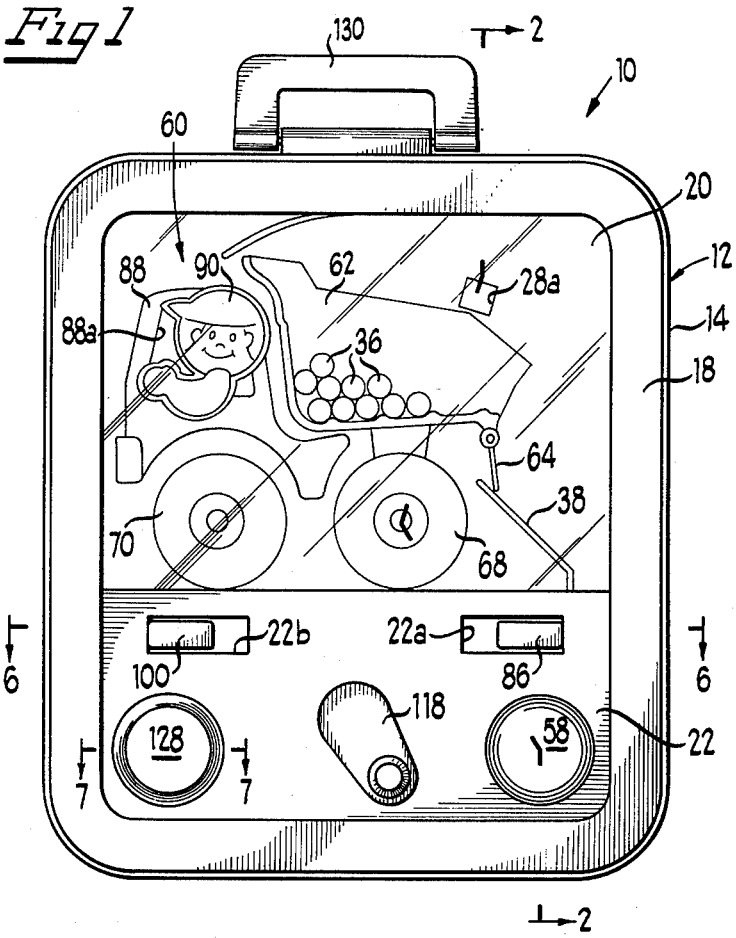
FIG. 1 is a front elevational view of a manual action toy constructed in accordance with the features of the present invention.

Referring now more particularly to the drawings, therein is illustrated a new and improved animated action toy constructed in accordance with the features of the present invention, and referred to generally by the reference numeral 10. The toy apparatus includes a generally, rectangularly-shaped, hollow housing or enclosure 12 preferably formed of molded plastic material and comprising a front half or section 14 which is assembled and joined together with a rear half section 16 along a middle plane.

Figure 2:
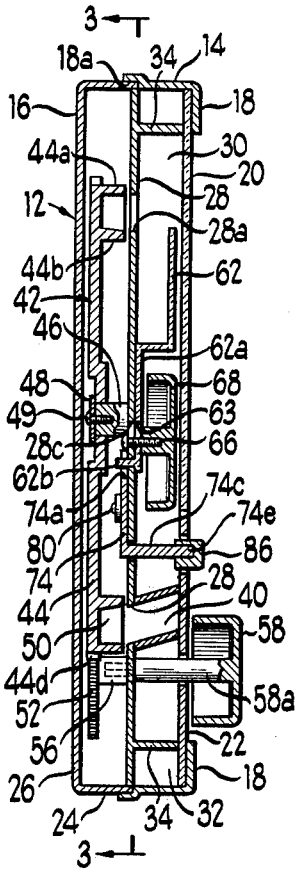
FIG. 2 is a vertical, cross-sectional view taken substantially along lines 2—2 of FIG. 1.
Figure 6:
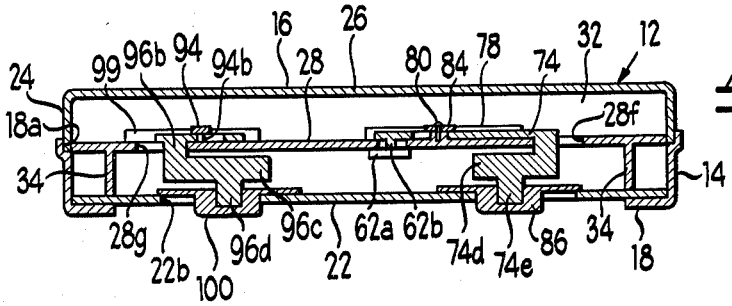
FIG. 6 is a horizontal, cross-sectional view taken substantially along lines 6—6 of FIG. 1.

The front half 14 of the housing 12 is formed with a continuous peripheral rim 18 having rounded corners and of angular, transverse, cross-section forming an enlarged, generally rectangular-shaped opening in the front of the housing. The housing includes a front wall supported by the rim 18 having a transparent, upper segment or window 20 and an opaque, lower portion or spandrel segment 22. The peripheral frame 18 of the front half is formed with a recess or shoulder **18*a* around a rearwardly facing edge on the inside surface as best shown in FIGS. 2 and 6 in order to receive and seat a forwardly facing, peripheral edge of a side wall 24 on the rear half or section 16. The side wall 24 is integral with a planar rear wall 26 generally parallel of the front window section 20 and spandrel section 22. When the front and rear halves 14 and 16** are assembled together and permanently joined, a selfcontaining enclosure or housing is formed with a seam at the middle.

The housing 12 is also provided with an intermediate divider wall 28, preferably, formed of opaque, molded plastic material and spaced approximately midway between the front and back wall panels and parallel thereof. The divider wall separates the housing into a front or window compartment 30, the interior of which is exposed to exterior view through the window section 20 and a rear or hidden compartment 32 which is hidden from external view by virtue of the opaque material of the walls that form the compartment.

Figure 4:
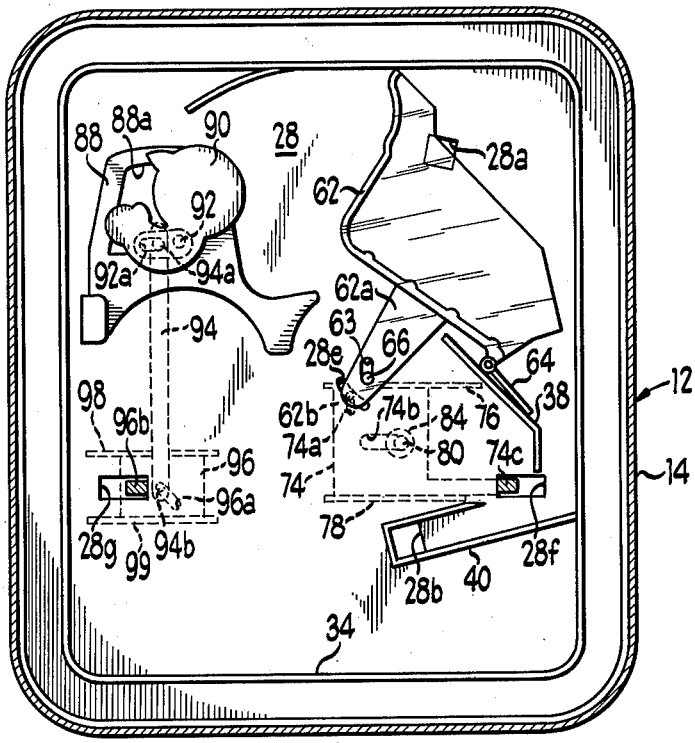
FIG. 4 is a vertical, cross-sectional view similar to FIG. 3 showing additional components of the toy.

As illustrated in FIG. 4, the desired spacing between the intermediate wall 28 and the respective front and back wall panels of the housing is attained by means of an integrally formed spacer rib 34 projecting forwardly at right angles to the intermediate wall and extending around the periphery of the wall but spaced inwardly from the outer edges thereof as best shown in FIG. 4.

Communication between the front and rear compartments 30 and 32 is provided through a pair of apertures or openings **28*a* and 28*b* and these openings are of square or rectangular shape as illustrated and are spaced apart at upper and lower levels as shown. The openings are dimensioned in order to permit the free passage of playing pieces 36 in the form of spherical marbles or balls of various colors and the balls or marbles are adapted to pass from the rear compartment 32 through the upper opening 28*a* into the front compartment 30 and eventually move from the front compartment back into the rear compartment through the lower opening 28*b*** as will be explained in more detail hereinafter.

For the purpose of guiding the balls received in the lower portion of the front compartment 30 at the level of the lower discharge opening **28*b*, the intermediate wall 28 is formed with an upper fixed, sloping wall segment 38 for directing the balls downwardly into a lower, sloping receiving chute or trough structure 40 having a lower end in communication with the discharge opening 28*b* as best shown in FIG. 4. Referring to FIG. 2, the upper and lower walls of the receiving trough 40 are sloped downwardly from the front panel 22 towards the rear so that the balls 36 will tend to automatically roll through the opening 28*b* into the rear or hidden compartment 32 of the enclosure 12**.

In accordance with the present invention, a manually controlled lift mechanism generally indicated by the reference numeral 42 and comprising a generally cylindrically-shaped rotary elevator 44 is mounted in the rear compartment 32 for transporting the balls from the lower opening **28*b* to the upper opening 28*a* while out of view. The elevator rotor includes a circular back wall mounted for rotation on a rearwardly, integrally formed, centrally located spindle 46 formed on the rear face of the intermediate, divider wall 28 as best shown in FIG. 2. The elevator rotor 44 is secured in place on the spindle by a retaining washer 48 and a cap screw 49**.

The rotor is formed with an integral, outer cylindrical side wall **44*a* and a smaller diameter, integral, circular inner wall 44*b* in concentric alignment therewith. A plurality of relatively short, radially extending, divider walls 44*c* extend between the outer side wall 44*a* and inner wall 44*b* to form a plurality of separate, ball receiving receptacles 50 arranged in a circular ring around the periphery of the elevator rotor 44. The individual receptacles 50 are dimensioned to contain a single ball or marble 36 received from the chute 40 and opening 28*b* in the intermediate wall and as the rotor is rotated about the spindle 46, the individual balls are lifted upwardly to an upper level adjacent the discharge opening 28*a*. As illustrated in FIG. 2, the inner ring 44*b* is formed with a frustoconical outwardly facing surface so that the balls contained in the compartments 50 will tend to roll freely outward through the upper level, discharge opening 28*a* and into the outer, window compartment 30 when a receptacle containing a ball is aligned in registration with the upper level opening. It should also be noted that the back side of the intermediate wall 28 cooperates with the open ended receptacles 50 to provide a containing wall structure for the balls in the rotor 44. The balls thus cannot fall out of their respective, containing receptacles 50 until the receptacle is positioned in registration with the upper level opening 28*a* in the intermediate wall 28**.

Figure 3:
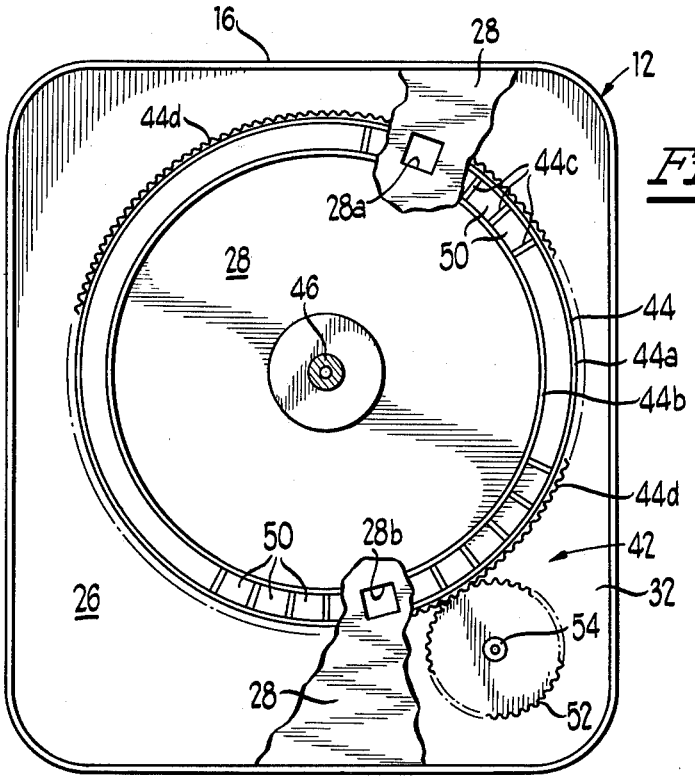
FIG. 3 is a vertical, cross-sectional view taken substantially along lines 3—3 of FIG. 2 with portions broken away for clarity.

In order to manually rotate the elevator 44, a ring of teeth **44*d* is provided thereon for driving engagement with a pinion 52 carried on the rearward end portion of a pinion shaft 54. The pinion shaft is journaled in a bushing 56 integrally formed on the rear face of the intermediate wall 28 as shown in FIGS. 2 and 3. A manual knob 58 having an inwardly extending, hollow stem 58*a* is attached to an outwardly extending, front portion of the pinion shaft 54 and rotation of the knob on the front of the housing 12 thus controls the rotation of the elevator 44 to raise or lower the balls 36 contained in the receptacles 50 thereof. The diameter of the pinion 52 is considerably smaller than the diameter of the ring of teeth 44*d* on the elevator rotor 44 so that one revolution of the knob 58** results in only a fraction of a revolution of the elevator rotor.

In accordance with the invention, the structure generally indicated by the numeral 60 is spaced to represent a dump truck (FIG. 1) and is permanently attached or mounted in the upper portion of the window compartment 30 for viewing through the window section 20. The dump truck includes a movable, ball receiving hopper 62 adapted to receive and hold a number of the balls 36 which are discharged from the upper level opening 28*a* in the intermediate wall 28. At the rear end, the hopper is open and is provided with a freely pivotal tail gate 64 adapted to guide the balls 36 downwardly onto the sloped upper wall segment 38 whenever the hopper is pivoted from a horizontal receiving or holding position of FIG. 1 to a rearwardly and downwardly sloping dumping or discharge position of FIG. 4.

Figure 5:
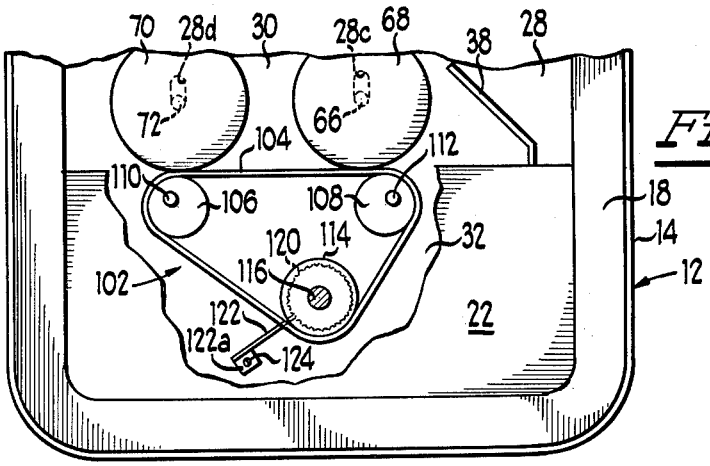
FIG. 5 is a fragmentary, front elevational view with portions broken away for clarity.

Preferably, the hopper structure is formed of molded plastic material and includes a downwardly extended supporting bracket 62*a* below the bottom wall and formed with an elongated slot 63 adapted to receive an axle pin 66. The pin is in the form of a cap screw having a threaded shank extending into a central spindle portion or hub of a rear truck wheel 68. The axle pin projects through a short, vertical slot 28*c* formed in the intermediate wall 28 so that the truck wheel 68 may move linearly up and down as well as rotate to provide a simulation of a truck moving down a bumpy road. A second or front wheel 70 for the dump truck is similarly mounted for vertical translation as well as rotary movement by means of a cap screw type axle pin 72 which projects through another vertical slot 28*d* parallel of the slot 28*c* in the intermediate wall 28 as shown in FIG. 5.

The hopper leg 62*a* is formed with a rearwardly projecting pin 62*b* at the lower end which is spaced below the slot 63 and extends through an arcuate slot 28*e* formed in the intermediate wall 28 to permit pivotal movement of the hopper leg about the axle pin 66 in order to dump the balls or marbles from the hopper.

A rearward end portion of the hopper pin 62*b* extends into a vertical slot 74*a* formed adjacent an upper left hand corner (FIG. 4) of a slide element 74 mounted for horizontal sliding movement on the rear face of the intermediate wall 28 between a pair of upper and lower, parallel guides 76 and 78 integrally formed on the wall. The slide 74 is provided with a horizontal slot 74*b* adjacent a central portion thereof and a threaded cap screw 80 extends through a retaining washer 84 and the slot to retain the slide in place during movement back and forth on the intermediate wall. The slide 74 is provided with a forwardly extending finger portion 74*c* which projects through a horizontal, slotted opening 28*f* in the intermediate wall 28 and engagement of the opposite sides of the finger portion and the respective opposite ends of the horizontal slot provide a limiting action on the amount of movement of the slide.

Accordingly, the degree of angular rotation during pivotal action of the dump truck hopper 62 is limited to the arcuate range as illustrated between the respective positions of FIGS. 1 and 4. The slide 74 includes an outer portion 74*d* disposed between the walls 28 and 22 and this portion is formed with a short key projection 74*e* (FIG. 6) on which is mounted a manually controllable, slide button 86. The slide button includes an outwardly projecting rectangular knob-like portion mounted in a horizontally extended, rectangular slot 22*a* in the opaque, lower front wall section 22. As viewed in FIG. 1, movement of the slide button 86 from right to left will cause the hopper leg 62*a* to pivot in a clockwise direction and the balls or marbles 36 in the hopper 62 will be dumped out of the open rear end to fall downwardly into the hopper-like area formed by the wall 38 for eventual collection in the sloping trough or chute 40 behind the opaque panel section 22. Return of the slide button 86 from left to right will return the hopper from the dumping position of FIG. 4 back to the generally horizontal, receiving and holding position as shown in FIG. 1.

In accordance with another aspect of the invention, the dump truck 60 includes a truck cab structure 88 integral with the outer face of the intermediate wall 28 and formed with a cab window 88*a* in which is mounted an animated figure in the form of a truck driver 90 having a face and arms. The driver is mounted for limited rocking or pivotal movement about a supporting pivot pin 92 on the wall 28 (FIG. 4). On the inside surface of the truck driver's arm there is provided a slotted out segment 92*a* in which is seated a pin 94*a* formed at the upper end of a vertically extending actuator element 94. At the lower end, the actuator element includes a similar pin 94*b* which is seated in a sloping, elongated slot 96*a* formed in a slide element 96 generally similar, but smaller, than the slide element 74 as previously described.

The body of the slide element 96 is disposed for horizontal, sliding movement between a pair of upper and lower parallel guides 98 and 99 integrally formed on the rear face of the intermediate wall 28. Movement of the slide 96 back and forth, right to left between the positions shown in FIGS. 4 and 6, respectively, causes the arm actuator 94 to move up and down and thus moves the arm and head of the truck driver in a rocking type motion about the pivot pin 92. The slide 96 includes an outwardly extending finger 96*b* which is disposed for sliding movement between opposite ends of a horizontally extending slot 28*g* formed in the intermediate walls 28 and aligned with the slot 28*f* on the opposite sides of the panel. The slide also includes an intermediate portion 96*c* between the walls 28 and 22 having an outwardly extending, short key projection 96*d* on which is mounted a slide element 100 disposed for horizontal sliding movement between the opposite ends of an elongated, horizontal slot 22*b* formed in the lower wall section 22 on the front wall of the panel compartment. Movement of the slide 100 back and forth between opposite ends of the horizontal slot 22*b* causes the animated truck driver 90 to rock back and forth as desired in the window 88*a* of the truck cab 88.

In accordance with the invention, the truck wheels 68 and 70 are driven to rotate and also move up and down as if the dump truck 60 was being driven over a bumpy road. A manually controlled mechanism for driving the wheels is referred to generally by the reference numeral 102 in FIG. 5 and includes an endless belt 104 having an upper run in contact with the wheels 68 and 70 which rest on an upper surface of the belt run. The endless belt is entrained about a pair of idler rollers 106 and 108 carried on eccentric shafts 110 and 112, respectively, projecting outwardly of the intermediate wall 28. A lower drive roll 114 is spaced between and below the idler rolls 106 and 108 and is rotated manually by means of a supporting axle 116 which projects outwardly through an opening in the lower front wall section 22 so that an external crank handle 118 may be attached thereto. Rotation of the crank handle moves the endless belt 104 around the eccentrically mounted rollers 106 and 108 and this causes the truck wheels 68 and 70 to rotate together in the same direction and also to bounce up and down because of the eccentricity of the idler rolls 106 and 108.

Turning of the crank 118 also generates a sound like that of a truck engine by means of a toothed, rachet wheel 120 that is mounted on a common crank shaft 116. Teeth of the wheel are adapted to engage and deflect the outer free end of a vibrating reed 122 having a bracket 122*a* at the opposite end fixedly secured to the intermediate wall 28 by a fastener 124. Rotation of the crank handle 118 thus generates a sound simulating the noise of a rolling dump truck as the wheels 68 and 70 thereof are rotated in either direction while at the same time bouncing up and down.

Figure 7:
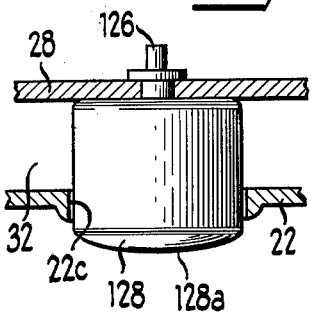
FIG. 7 is a fragmentary, horizontal, cross-sectional view taken substantially along lines 7—7 of FIG. 1.

Referring to FIGS. 1 and 7, another feature of the present invention comprises a pneumatic whistle 126 which is mounted in an opening provided on the intermediate wall 28 and which is activated by a hollow, pneumatic chamber 128 preferably formed of flexible plastic material. The chamber includes a convex outer face 128*a* which extends outwardly of the wall section 22 through a large circular opening 22*c* provided therein. Finger pressure exerted inwardly on the outer face 128*a* of the chamber forces air through the whistle 126 to produce a "tooting sound" similar to the toot of a horn on a dump truck.

For convenience, a carrying handle 130 is provided for the toy apparatus and from the foregoing it will be seen that the animated action toy 10 in accordance with the present invention generates both sights and sounds similar to those of an operating dump truck. The toy is well designed to serve as a useful plaything for young children.

Although the present invention has been described with reference to a single embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Toy apparatus comprising:

a housing having a plurality of separate compartments in communication with each other with a first compartment having an exterior wall of light transmitting material for external viewing of the interior thereof;

at least one playing piece adapted to move between said compartments;

a hopper in said first compartment mounted for movement between a first position for holding and receiving playing pieces discharged from a second compartment into said first compartment and a dumping position;

means for moving said playing piece(s) dumped from said hopper through said second compartment for discharge into said hopper in receiving position in said first compartment, said moving means comprises a member mounted for rotation in said housing including a plurality of separate receptacles for containing a playing piece and movable upon rotation of said member from a lower receiving level to an upper discharge level above said hopper and, an intermediate wall for dividing said housing into separate compartments, said intermediate wall positioned to closely face open ends of said receptacle and formed with discharge openings adjacent said upper and lower levels.

2. The toy apparatus of claim 1 including an intermediate wall in said housing dividing the same into said first and second compartments, said intermediate wall cooperating with said receptacles of said rotating member for retaining a playing piece in the receptacles until reaching said discharge level.

3. The toy apparatus of claim 2 wherein said intermediate wall is formed with a discharge opening at said upper level for discharging a playing piece from a receptacle in said rotating member into said hopper.

4. The toy apparatus of claim 3 wherein said intermediate wall includes a second discharge opening at a lower level for directing said at least one playing piece dumped from said hopper into a receptacle of said rotating member at said receiving level.

5. The toy apparatus of claim 1 wherein said rotating member is formed with a ring of teeth around the axis of rotation and including manual means rotating a pinion engaging said teeth to rotate said member.

6. The toy apparatus of claim 5 wherein said rotating member is circular in shape with a plurality of said receptacles around the periphery thereof, said teeth formed in a ring around an outer side wall of said receptacles.

7. The toy apparatus of claim 1 wherein said hopper is pivotally mounted adjacent structure in said first compartment shaped to resemble a dump truck including a pair of wheels and a cab, and manual crank means drivingly connected to rotate said wheels.

8. The toy apparatus of claim 7 including manual means for moving said hopper between said receiving position and said dumping position for discharging said playing piece(s) held therein.

9. The toy apparatus of claim 7 including a driver mounted in said cab and manual means for moving said driver relative to said cab.

10. The toy apparatus of claim 7 including air whistle means on said housing including an air chamber depressible to blow said whistle.

11. The toy apparatus of claim 7 wherein at least one of said truck wheels is mounted for rotation and movement up and down on said housing and including drive means interconnecting said manual crank means and said one truck wheel having a rotating drive element mounted for rotation on a shaft eccentric thereof for impacting rotary motion and up and down travel to said one truck wheel as said manual crank means is rotated.

12. The toy apparatus of claim 11 including a plurality of said drive elements mounted on spaced apart shafts eccentric thereof and endless belt means for drivingly interconnecting said plurality of said drive elements and said manual crank means.

13. The toy apparatus of claim 12 wherein said endless belt means includes an upper run supported on said drive elements and drivingly engaging said truck wheels.

14. The toy apparatus of claim 7 including a sound generator activated by movement of said manual crank means.

15. Toy apparatus comprising:

a housing having a plurality of separate compartments in communication with each other with a first compartment having an exterior wall of light transmitting material for external viewing of the interior thereof;

at least one playing piece adapted to move between said compartments;

a hopper in said first compartment mounted for movement between a first position for holding and receiving playing pieces discharged from a second compartment into said first compartment and a dumping position; and means for moving said playing piece(s) dumped from said hopper through said second compartment for discharge into said hopper in receiving position in said first compartment, said hopper is pivotally mounted adjacent structure in said first compartment shaped to resemble a dump truck including a pair of wheels and a cab, and manual crank means drivingly connected to rotate said wheels.

16. The toy apparatus of claim 15 wherein at least one of said truck wheels is mounted for rotation and movement up and down on said housing and including drive means interconnecting said manual crank means and said one truck wheel having a rotating drive element mounted for rotation on a shaft eccentric thereof for impacting rotary motion and up and down travel to said one truck wheel as said manual crank means is rotated.

17. The toy apparatus of claim 16 including a plurality of said drive elements mounted on spaced apart shafts eccentric thereof and endless belt means for drivingly interconnecting said plurality of said drive elements and said manual crank means.

18. The toy apparatus of claim 17 wherein said endless belt means includes an upper run supported on said drive elements and drivingly engaging said truck wheels.

19. The toy apparatus of claim 15 including manual means for moving said hopper between said receiving position and said dumping position for discharging said playing piece(s) held therein.

20. The toy apparatus of claim 15 including a driver mounted in said cab and manual means for moving said driver relative to said cab.

21. The toy apparatus of claim 15 including air whistle means on said housing including an air chamber depressible to blow said whistle.

22. The toy apparatus of claim 15 including a sound generator activated by movement of said manual crank means.

* * * * *